US005301371A

United States Patent [19]

Chao

[11] Patent Number: 5,301,371

[45] Date of Patent: Apr. 12, 1994

[54] SAFETY VEST TO BE USED IN A CAR

[76] Inventor: Wen-Chung Chao, No. 22, Lane 309, Chung-Shan Rd., Sec.2, Pan-Chiao City, Taipei Hsien, Taiwan

[21] Appl. No.: 912,551

[22] Filed: Jul. 10, 1992

[51] Int. Cl.[5] ..... A41D 1/04

[52] U.S. Cl. ..... 2/102; 297/464; 297/465; 297/468; 280/801.2; 280/801.1

[58] Field of Search ..... 2/102, 94, 108, 69, 2/115; 280/801 A, 801 R; 297/464, 465, 468

[56] References Cited

U.S. PATENT DOCUMENTS 3,992,040 11/1976 Gannac ..... 297/465
4,731,882 3/1988 Ekman ..... 2/94
4,848,793 7/1989 Huspen et al. ..... 297/465
4,955,456 9/1990 Mulkey ..... 2/94

*Primary Examiner*—Clifford D. Crowder
*Assistant Examiner*—Gloria Hale
*Attorney, Agent, or Firm*—W. Wayne Liauh

[57] ABSTRACT

A safety vest to be used in a car and more particularly a safety vest to be worn by a child in a car; the safety vest comprises a vest portion and a plurality of safety belts being fixed inside the lamina of the vest portion; the front opening of the vest portion is furnished with buckle assemblies whereby the safety vest can be put securely on a child. The back of the vest has two slots, through which a car safety (or seat) belt is inserted so as to allow the safety vest fixedly mounted on car seat; since the car safety belt and the safety vest are assembled together, a larger restraining area can be formed and applied to a child, and in case of emergency or accident, the injury to a child would be minimized.

2 Claims, 4 Drawing Sheets

SAFETY VEST TO BE USED IN A CAR

BACKGROUND OF THE INVENTION

Recently, the number of mother or father drivers who have to carry their baby around has increased considerably. As a consequence, the baby has more chances than ever to sit beside a mother or father driver. Unfortunately, the conventional car safety belt (or seat belt) is evidently not capable of protecting the baby in a car in case of accident. The worst of it is that some children were strangled to death in an accident as a result of the seat belt. In the market, there are available safety chairs for babies who sit in a car so as to provide greater protections.

The aforesaid safety chair is substantially a simple seating chair, which includes a cushion, a back frame and a safety belt; the seating chair is then fastened in place with a seat belt.

Apparently, the aforesaid safety chair has a complex structure, which causes a higher cost that may not be affordable the ordinary consumers; the structure of such safety chair is good only for children who are young and not too tall, but is not good for children who have grown a little older or higher; further, such a safety chair takes a considerable storage space when not in use; to a small car which has a limited space, such a safety chair is deemed not an ideal structure designed. Moreover, a simple seat chair would give rise to a problem, i.e., it is rather difficult to keep a child to sit thereon quietly and patiently.

SUMMARY OF THE INVENTION

This invention relates to a safety vest to be used in a car, and particularly to a safety vest for children. The safety vest comprises a vest portion and a plurality of safety belts mounted between the lamina of the vest portion. The front side of the vest portion has buckle assemblies, whereby the vest can be fixedly put onto a child. The back side of the vest portion has slots, through which a car safety (or seat belt) can be inserted therethrough so as to fasten the safety vest on a car seat. The primary object of the present invention is to provide a safety vest to be worn by a child when sitting in a car; since the safety vest and the safety belt are assembled together, the entire safety vest would hold and support a child in case of an accident taking place. The present invention also provides a safety vest which can eliminate a defect of the conventional safety chair i.e., it is unable to fit an elder child who has not reached the condition of using an adult seat belt; the present invention has also eliminated a defect of a conventional seat belt which would kill a person by strangling his (or her) throat in case of an accident taking place.

Another object of the present invention is to provide a safety vest which has smaller dimensions, and can be folded up as a piece of garment for storage; since it is made of a soft material, it would not take a large space for storage as a conventional safety chair does.

Still another object of the present invention is to provide a safety vest, which can fit children of various ages and body sizes because of the vest able to be made into a range of different sizes for children having different physical shapes; usually, the size of the conventional safety chair is able to change for children requiring different sizes.

A further object of the present invention is to provide a safety vest, which would not cause a child to have a psychological resistance that is usually present when using a conventional safety chair because the child feels that he or she is being fastened to a chair. On the contrary, a child would feel the vest being the same as an ordinary garment put on; therefore, he (or she) would quietly and patiently sit in a car seat. Moreover, since the safety vest is to be fastened to a car seat by using a seat belt, a child can leave a car seat by taking off the safety vest or by separating the vest from the seat belt, i.e., the safety vest being still on one's body. Since the present invention has a simple structure, it is easy to make at a lower manufacture cost for mass production.

DETAILED DESCRIPTION

Figure 1:
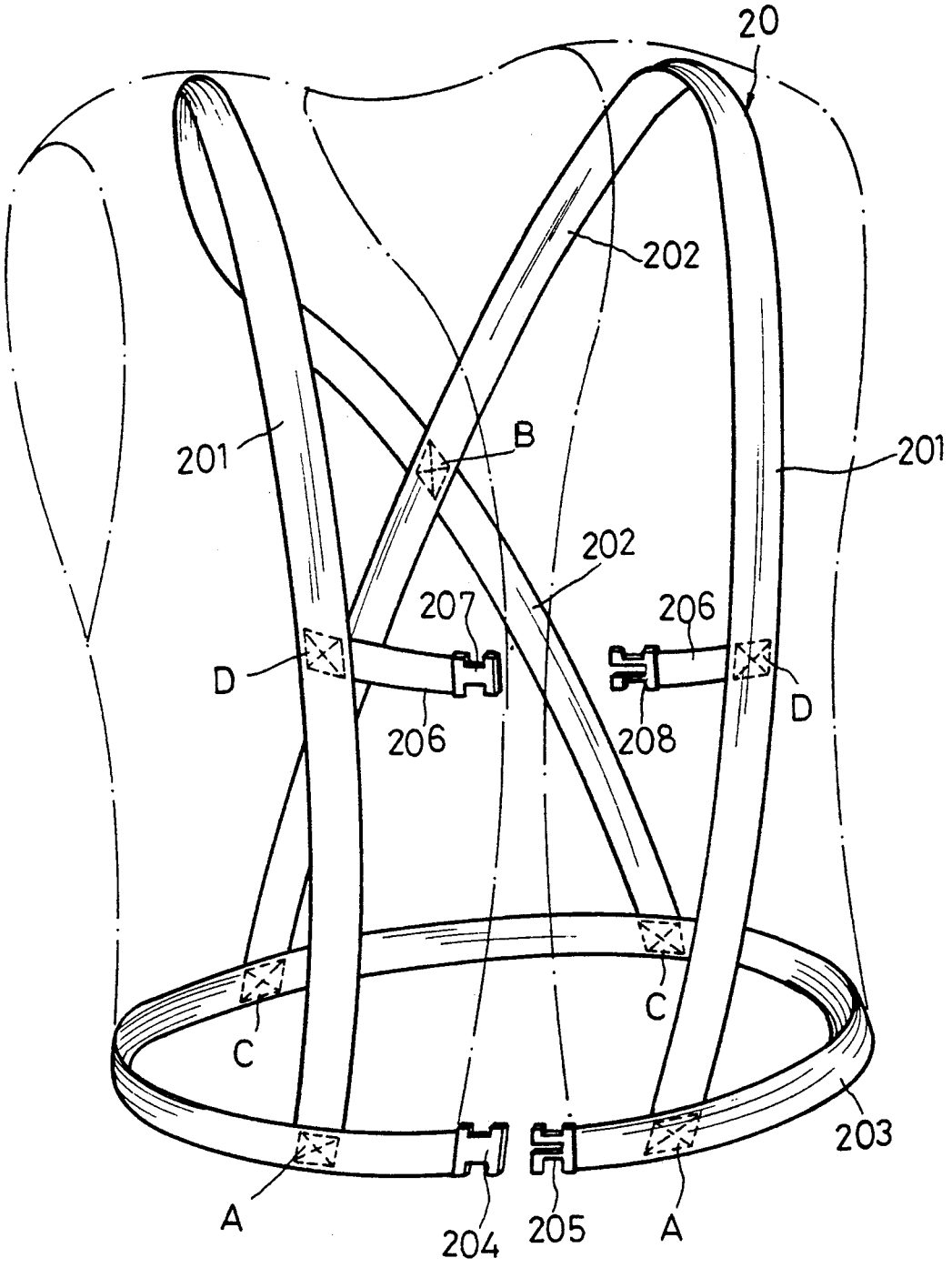
FIG. 1 is a perspective view of the inner safety belt structure of an embodiment according to the present invention.
Figure 2:
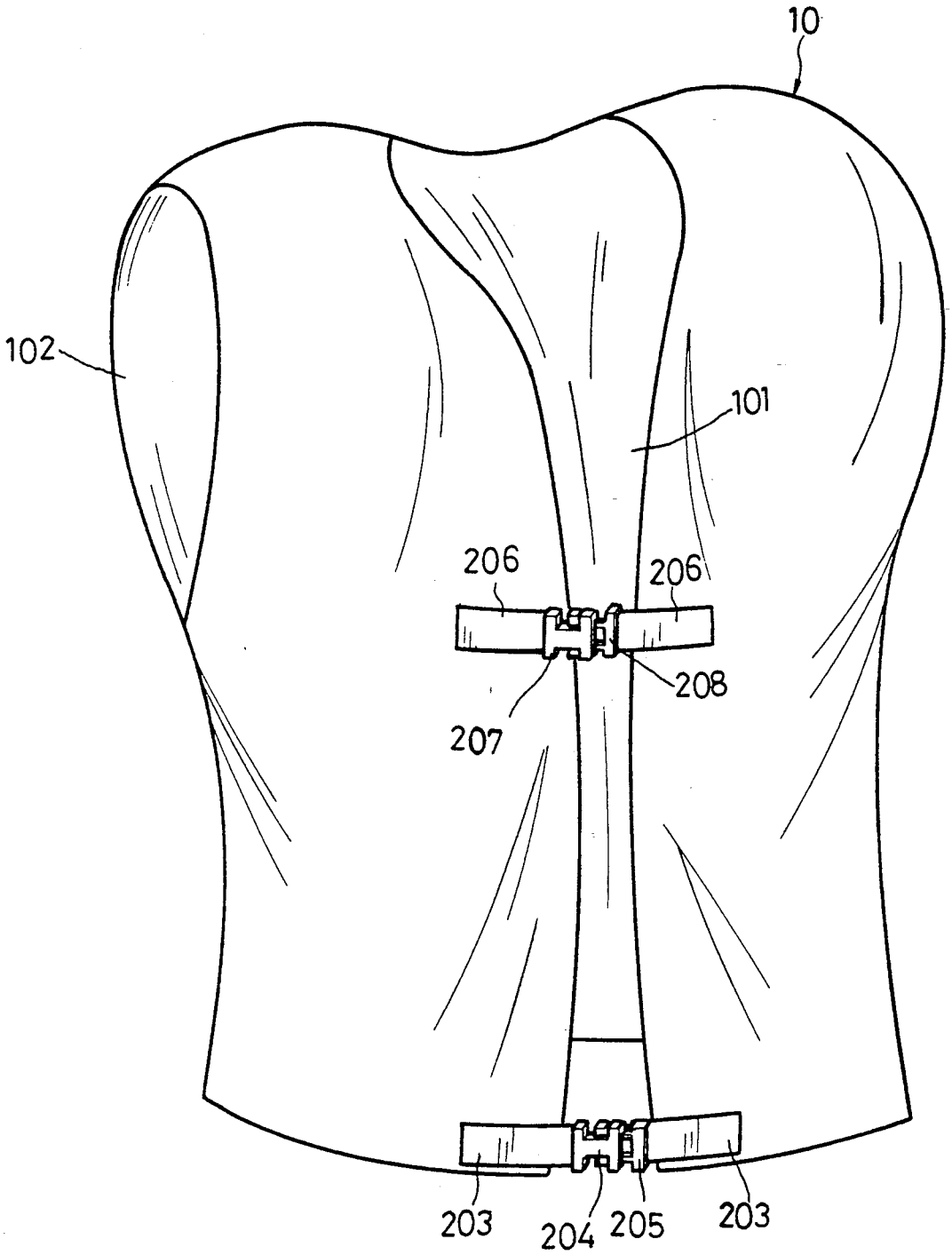
FIG. 2 is an outer view of the embodiment of the present invention.
Figure 3:
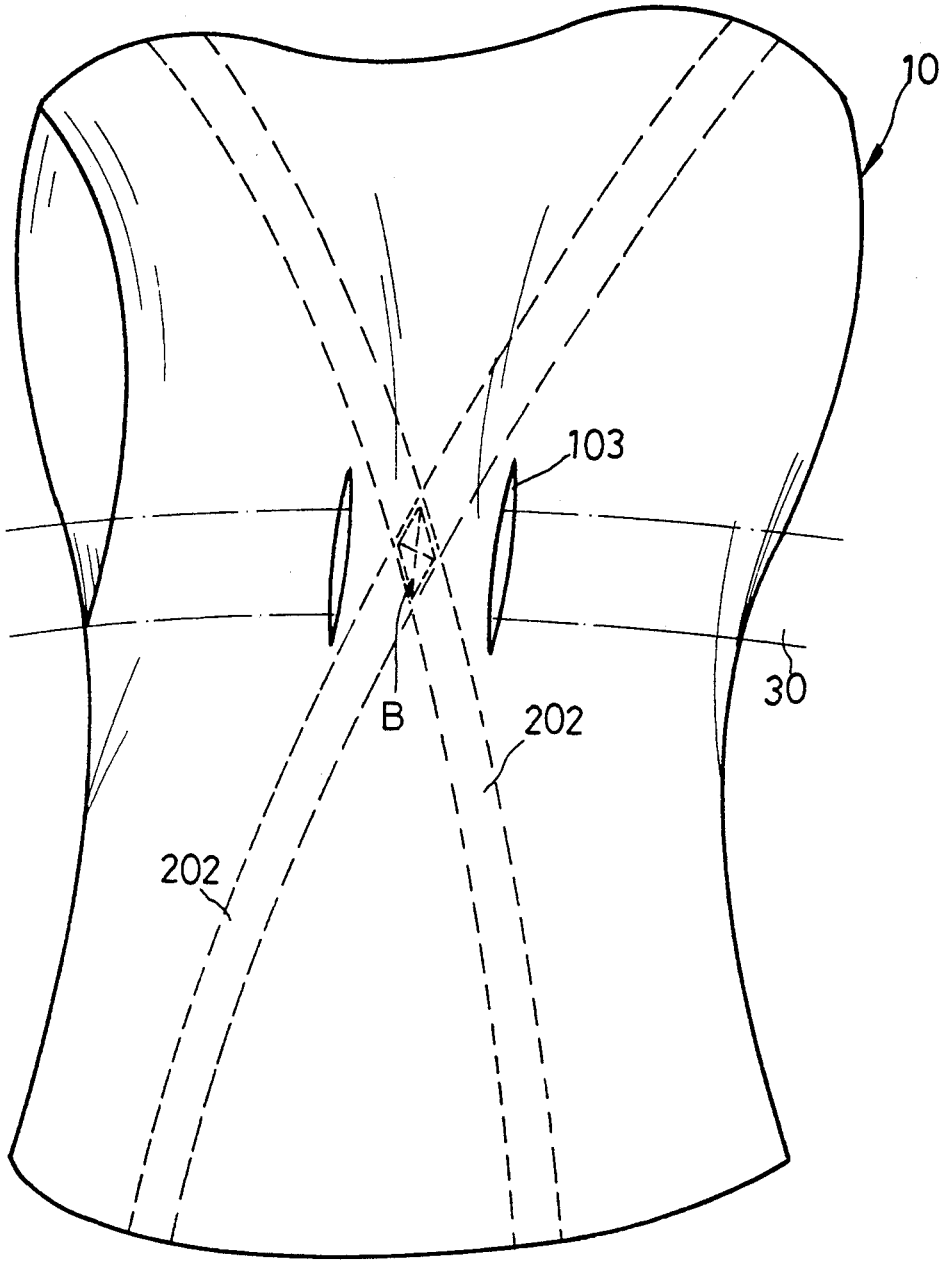
FIG. 3 is a rear side view of the embodiment of the present invention.
Figure 4:
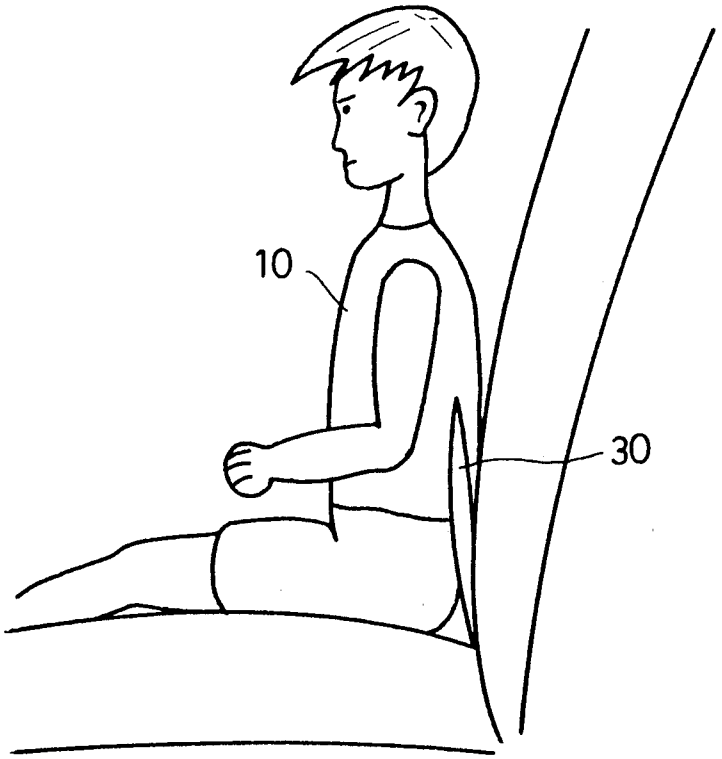
FIG. 4 illustrates the embodiment of the present invention being operated.

Referring to FIGS. 1 and 2, the present invention comprises a vest portion 10 and an inner safety belt 20. The safety belt includes two front belts 201 mounted on the left and right sides of the front body of a person, and the front belts 201 are connected respectively with a waist belt 203 at points "A", and arranged in parallel, extending to the back side of the vest portion and becoming crossed at point "B", and finally being connected with the waist belt 203 at points "C" respectively. Both ends of the waist belt 203 are furnished with buckle assemblies 204 and 205. The two front belts 201 are attached with two fastening straps 206 at points "D" res-pectively; both ends of the fastening straps 206 are mounted with buckle assemblies 207 and 208. (The buckle assemblies 204, 205, 207 and 208 are made of a conventional inserting type of buckle structure). The connecting points "A", "B", "C" and "D" among the belts are formed by respectively sewing various belts together as shown in FIGS. 1 and 2. The vest 10 looks like a conventional vest with an opening 101 in the front side thereof, and having two openings 102 on both sides thereof to let arms pass through. The safety belts 20 are fixedly sewed between the lamina of the vest portion 10, i.e., the safety belts 20 are covered with the vest portion 10. All the buckle assemblies 204, 205, 207 and 208 are attached on the outer surface of the front middle parts of the vest so as to facilitate reach by the user's hands. On both sides of the intersecting point "B" of the two back belts 202, there are two slots 103 respectively, through which a car safety belt can pass smoothly. The intersecting point "B" of the two back belts 202 is located in the rear part of the lamina of vest portion 10, and is sewed at a point where the car safety belt can conveniently pass and set at the same level when the belt passing through the slots 103; that intersecting point "B" provides the fulcrum for holding the person wearing the safety vest.

In actual applications, the vest portion 10 has to be put on first; all the buckle assemblies 204, 205, 207 and 208 are then fastened in place. The slots 103 in the back side of the vest portion 10 are to be inserted through with a car safety belt 30 so as to have the vest fixedly mounted on a car seat. The vest might be attached to the car safety belt first before being put on by a person.

Since the vest and a car safety belt are assembled together, a person such as a child seating in a car can be protected, in case of having an accident, to minimize the injury, if any, because that the whole safety vest can absorb a shock. Moreover, the safety vest is designed into various sized for comfortable wear, and it can be folded up for storage in a small space; the convenient features of the present invention are never found in the conventional equipment of the kind.

I claim:

1. A safety vest to be used in a car in cooperation with a car safety belt, said safety vest having a left side, a right side, a front side, and a back side, and comprising:

(b) a vest portion and a plurality of safety belts inside said vest portion;

(b) said safety belts including two front belts to be placed on the left and right sides, respectively, of said vest in a parallel manner, and said front belts are extended to the back side of said vest portion to become two back belts, respectively, said two back belts intersect each other;

(c) both said front belts and said back belts are fixedly attached to a waist belt, which is substantially a ring-shaped belt, said ring-shaped belt has an opening in the front side of said vest portion;

(d) said opening of said ring-shaped belt is attached with a pair of first buckle assemblies allowing said opening to be closed;

(e) each of said front belts is attached with a fastening strap, said fastening strap is provided with a matching second buckle assembly at its end so as to allow said fastening straps to be fastened together;

(f) said safety vest being the same as a conventional vest having a front opening, which allows said safety vest to be put on a user's body, and two openings on the upper side thereof to allow the user's arms to pass therethrough;

(g) said safety vest further having two slots being provided in the back side of said vest portion so as to allow a car safety belt to pass therethrough; and (h) said safety belts being fixedly attached to said vest portion so as to have said vest portion and said safety belts combined together as one piece, whereby when said car safety belt is inserted through said slots on the back side of said vest portion, said safety vest will be fastened onto a car seat.

2. The safety vest of claim 1 wherein said vest portion comprises at least two lamina and said safety belts are sewn between said two lamina.

* * * * *